US007077114B2

(12) United States Patent
Hüsges

(10) Patent No.: US 7,077,114 B2
(45) Date of Patent: Jul. 18, 2006

(54) EXHAUST GAS RECIRCULATION SYSTEM FOR A COMBUSTION ENGINE

(75) Inventor: Hans-Jürgen Hüsges, Willich (DE)

(73) Assignee: Pierburg GmbH, Neuss (DE)

( * ) Notice: Subject to any disclaimer, the term of this patent is extended or adjusted under 35 U.S.C. 154(b) by 0 days.

(21) Appl. No.: 11/111,755

(22) Filed: Apr. 22, 2005

(65) Prior Publication Data

US 2005/0235973 A1 Oct. 27, 2005

(30) Foreign Application Priority Data

Apr. 22, 2004 (DE) ..... 10 2004 019 554

(51) Int. Cl.
*F02B 47/08* (2006.01)
*F02B 47/00* (2006.01)

(52) U.S. Cl. ..... 123/568.12; 60/602.2

(58) Field of Classification Search ..... 123/568.12, 123/568.11, 41.31; 60/605.2
See application file for complete search history.

(56) References Cited

U.S. PATENT DOCUMENTS

| | | | | |
|---|---|---|---|---|
| 2,977,940 | A * | 4/1961 | Theriault | 123/25 B |
| 3,937,196 | A * | 2/1976 | Cook et al. | 123/568.12 |
| 5,970,960 | A * | 10/1999 | Azuma | 123/568.12 |
| 2004/0107949 | A1* | 6/2004 | Miyoshi et al. | 123/568.12 |
| 2004/0206342 | A1* | 10/2004 | Moyer et al. | 123/568.12 |

FOREIGN PATENT DOCUMENTS

| | | | |
|---|---|---|---|
| DE | 3511638 | C2 | 10/1986 |
| DE | 197 40 998 | A1 | 3/1998 |
| DE | 198 41 927 | A1 | 3/2000 |
| DE | 103 21 638 | A1 | 1/2004 |
| EP | 0 916 837 | B1 | 10/1998 |
| JP | 2005273564 | A * | 10/2005 |
| WO | WO 01/44651 | A1 | 6/2001 |

OTHER PUBLICATIONS

Office Action Issued in Corresponding German Application No. 10 2004 019 554.4, dated Nov. 26, 2004.

* cited by examiner

*Primary Examiner*—Mahmoud Gimie
(74) *Attorney, Agent, or Firm*—Griffin & Szipl, P.C.

(57) ABSTRACT

An exhaust gas recirculation system for a combustion engine is proposed that includes all important functions within a housing. For this purpose an exhaust gas recirculation valve, an exhaust gas cooling device with a heat exchanger unit, as well as a bypass channel with a bypass flap likewise embodied in the housing, form a unit. In addition, the exhaust gas recirculation valve in the area of its valve seat is cooled by the coolant of the exhaust gas cooling device. Thus a solution is proposed that, in comparison with known exhaust gas recirculation systems, greatly reduces construction space and weight, at the same time features low-cost assembly, and is also to be implemented very cost-effectively by the possibility of producing all housing parts in the die-casting method.

14 Claims, 3 Drawing Sheets

EXHAUST GAS RECIRCULATION SYSTEM FOR A COMBUSTION ENGINE

CROSS-REFERENCE TO RELATED APPLICATIONS

This application claims priority of DE 10 2004 019 554.4, filed on Apr. 22, 2004, the entire disclosure of which is hereby incorporated by reference.

BACKGROUND OF THE INVENTION

1. Field of the Invention

The invention relates to an exhaust gas recirculation system for a combustion engine with an exhaust gas inlet, an exhaust gas outlet, and an exhaust gas cooling device that features a heat exchanger unit through which a coolant flows, as well as with a bypass channel via which the heat exchanger unit can be bypassed and in which a bypass flap is arranged.

2. Background Art

In the known exhaust gas recirculation systems, the exhaust gas is conducted from the exhaust manifold back to the induction pipe of the combustion engine via an exhaust gas recirculation channel. The exhaust gas flow is regulated thereby by an exhaust gas recirculation valve arranged in the exhaust gas recirculation channel.

Moreover it is known to arrange cooling devices in the exhaust gas recirculation channels so that the exhaust gas is fed back into the induction pipe cooled, as a result of which the $NO_x$ emissions can be reduced. However, since the fastest possible heating of the coolant and also of a catalyst is desired when the engine is started, exhaust gas recirculation systems were embodied in which the exhaust gas cooling device can be bypassed via a bypass channel, whereby the bypass channel is governed by a bypass flap or a bypass valve.

In DE 198 41 927 A1, a device is described for recirculating an exhaust gas flow to the induction pipe of a combustion engine, in which the exhaust gas cooling device is embodied with the bypass channel as a unit in which the bypass flap is arranged between an exhaust gas inlet and an exhaust gas outlet of the cooling device, so that the path through the cooler can be bypassed via the bypass channel. The exhaust gas recirculation valve regulating the amount of exhaust gas is arranged in the subsequent region of the exhaust gas recirculation channel. By embodying the cooler with the bypass channel as a unit, a compact construction with a reduction in construction space and weight resulting therefrom is to be achieved.

In EP 0 916 837 B 1 a device for the exhaust gas recirculation for a combustion engine is described in which the exhaust gas cooling device and the exhaust gas recirculation valve are embodied as a unit, whereby a control element of the valve is cooled at the same time by the flowing coolant. This is intended to result in a reduction of the thermal load of the control element. Bypassing the exhaust gas cooler via a bypass channel is not provided for.

In DE 197 40 998 A1 an exhaust gas recirculation system for a combustion engine is described in which an exhaust gas recirculation valve is mounted on a connection base that is in turn mounted on a cooling device arranged on the induction pipe. The thermal load of the inlet manifold is to be reduced by such a design. However, based on the design the cooling device present here serves primarily for the thermal uncoupling of the induction pipe from the exhaust gas recirculation valve, whereby an adequate cooling of the exhaust gas to reduce the $NO_x$ emission is not provided for.

SUMMARY OF THE INVENTION

It is therefore the object of the invention to make available an exhaust gas recirculation system that fulfils all the currently necessary functions of exhaust gas recirculation with the least possible construction space and with weight reduced as far as possible, whereby the service life and function of the components is to be ensured or increased at the same time in the most cost-effective manner possible. Moreover all the components of the exhaust gas recirculation system are to be coordinated optimally.

A preferred embodiment of the invention is an exhaust gas recirculation system for a combustion engine comprising: an exhaust gas inlet; an exhaust gas outlet; an exhaust gas recirculation valve; an exhaust gas recirculation valve housing; an exhaust gas cooling device including a heat exchanger unit constructed to allow flow of coolant therein, a bypass channel connected to bypass the heat exchanger unit, and a bypass flap disposed in the bypass channel; and a housing containing the heat exchanger unit, the bypass flap, and at least a portion of the housing the exhaust gas recirculation valve, wherein at least one valve seat is disposed in the portion of the exhaust gas recirculation valve housing; whereby the valve seat is coolable by the coolant; and wherein the exhaust gas recirculation valve, the exhaust gas cooling device, the heat exchanger unit, and the bypass channel form a unit. Thus all the required functions of a modern exhaust gas recirculation system are brought together in one unit, whereby the weight and the construction space needed are further limited compared with the prior art and in particular the function of the exhaust gas recirculation valve is ensured additionally by the cooling of the valve seat, since a sticking of a valve element on the valve seat by carbonization is largely avoided by means of the additional cooling of the valve seat.

Another preferred embodiment of the invention is an exhaust gas recirculation system for a combustion engine according to above embodiment, wherein said valve seat of said exhaust gas recirculation valve is disposed between said bypass channel or said heat exchanger unit and said exhaust gas outlet. In this way the thermal load in particular of any control element of the exhaust gas recirculation valve is reduced compared with embodiments in which the exhaust gas recirculation valve is arranged upstream of the exhaust gas cooler.

In yet another preferred embodiment of the invention, the housing of the exhaust gas recirculation system and the heat exchanger unit is constructed from a total of four housing shells. Such an embodiment minimizes the assembly cost of the exhaust gas recirculation system, whereby at the same time the shapes can be selected such that the four housing shells can be produced in a cost-effective light metal die-casting method.

In still another preferred embodiment of the invention, the shells are die-cast shells.

In yet another preferred embodiment of the invention, a first housing shell forms the exhaust gas inlet, a lower part of the exhaust gas cooling device, and a lower outer wall of the bypass channel; a second housing shell forms an upper part of the exhaust gas cooling device including a coolant inlet and a coolant outlet, and an upper outer wall of the bypass channel; a third housing shell forms a lower part of the heat exchanger unit, a lower part of the housing of the exhaust gas recirculation valve, the exhaust gas outlet, a lower inner wall of the bypass channel, and a lower part of an intermediate wall in which the bypass flap is disposed including a lower bearing position of the bypass flap; and a fourth housing shell forms an upper part of the heat exchanger unit, an upper part of the housing of the exhaust gas recirculation valve, an upper inner wall of the bypass channel, and an upper part of the intermediate wall in which the bypass flap is disposed including an upper bearing position of the bypass flap. Such a distribution of the functions over the four housing shells results in a simple shaping, so that the housing shells can be produced in the die-casting method. In addition it results in a small number of individual components that are simple to assemble as well as a reduced construction space requirement.

In still another preferred embodiment of the invention, the exhaust gas recirculation valve comprises a connector valve inside the exhaust gas recirculation valve housing and the valve seat is disposed to be coolable by coolant flowing around it. The embodiment of the exhaust gas recirculation valve as a connector valve in turn simplifies the assembly while the fact that coolant flows around the valve seat optimizes the cooling effect on the housing or on the valve seat of the exhaust gas recirculation valve, so that sticking of the exhaust gas recirculation valve is reliably avoided.

In yet another preferred embodiment of the invention, a first housing shell forms the exhaust gas inlet, the exhaust gas outlet, a lower part of the exhaust gas cooling device, a lower part of the bypass channel, and the exhaust gas recirculation valve housing, the second housing shell forms an upper part of the exhaust gas cooling device, the coolant inlet, the coolant outlet, and an upper part of the bypass channel, the third housing shell forms a lower part of the heat exchanger unit, a lower part of an intermediate wall in which the bypass flap is disposed including a lower bearing position of the bypass flap, and the fourth housing shell forms an upper part of the heat exchanger unit and an upper part of the intermediate wall in which the bypass flap is disposed including an upper bearing position of the bypass flap. Such a housing system can be produced completely in the die-casting method and due to the coolant flowing around the heat exchanger unit, features a very good heat transfer, whereby likewise a simple assembly of the housing shells is ensured. Compared with the alternative form of embodiment, there is in addition the advantage that through the one-piece embodiment of the exhaust gas recirculation valve housing, an additional sealing between the housing halves in this region is not required.

In a still further form of embodiment, the exhaust gas recirculation valve is in turn embodied as a connector valve in the housing and whose valve seat is arranged for cooling immediately adjacent to a coolant jacket embodied between the first and third housing shell as well as between the second and fourth housing shell. In this way a cooling of the valve seat is achieved while maintaining the above-mentioned advantages, whereby a somewhat lower effect of the coolant on the valve seat is present compared with the alternative form of embodiment.

In yet another preferred embodiment, the bypass flap is controlled at least indirectly via a temperature-sensitive bi-metal spring. Thus, additional construction space can be saved, since further control devices for the bypass flap are not required.

In a further embodiment of the invention, the coolant flows around the bi-metal spring. This way the bypass flap is swiveled depending on the respective coolant temperature. This means that when the combustion engine is still cold and thus when cooling of the exhaust gas is not desired, the bi-metal spring is arranged so that the bypass flap is opened, whereas when the coolant is sufficiently heated, the bi-metal spring ensures the closing of the bypass channel.

In yet another preferred embodiment, the housing is a plurality of housing shells connected via one or more adhesive connections between one or more grooves in a housing shell and one or more bars in another housing shell. Thus the exhaust gas recirculation system can be assembled in a simple and cost-effective manner, since time-consuming welding or screwing connections are unnecessary and the entire exhaust gas recirculation system can be assembled simply by placing the shells on top of one another.

In still another preferred embodiment of the invention, a coolant jacket in the area of the cooling device surrounds the entire circumference of the heat exchanger unit in cross-section. This arrangement produces good efficiency and energy savings.

In yet another preferred embodiment, the connection between the bars and grooves is disposed in the area of the coolant jacket and the one or more further grooves are disposed so as to make an air space between an area of the heat exchanger unit through which the exhaust gas flows and the bars and grooves on both housing shells. This air space serves as insulation against the hot exhaust gas, so that a reliable adhesive connection can also be implemented at this point.

Thus through the said embodiments an exhaust gas recirculation system is created that has an extremely low construction space requirement and a low weight, whereby at the same time in particular the function of the exhaust gas recirculation valve is ensured by the cooling and the number of components is further reduced in comparison with known embodiments. Furthermore, all housing parts can be produced in the cost-effective die-casting methods and coordinated optimally.

Two exemplary embodiments of exhaust gas recirculation systems according to the invention are shown in the drawings and are described below.

DETAILED DESCRIPTION OF THE INVENTION

Figure 1:
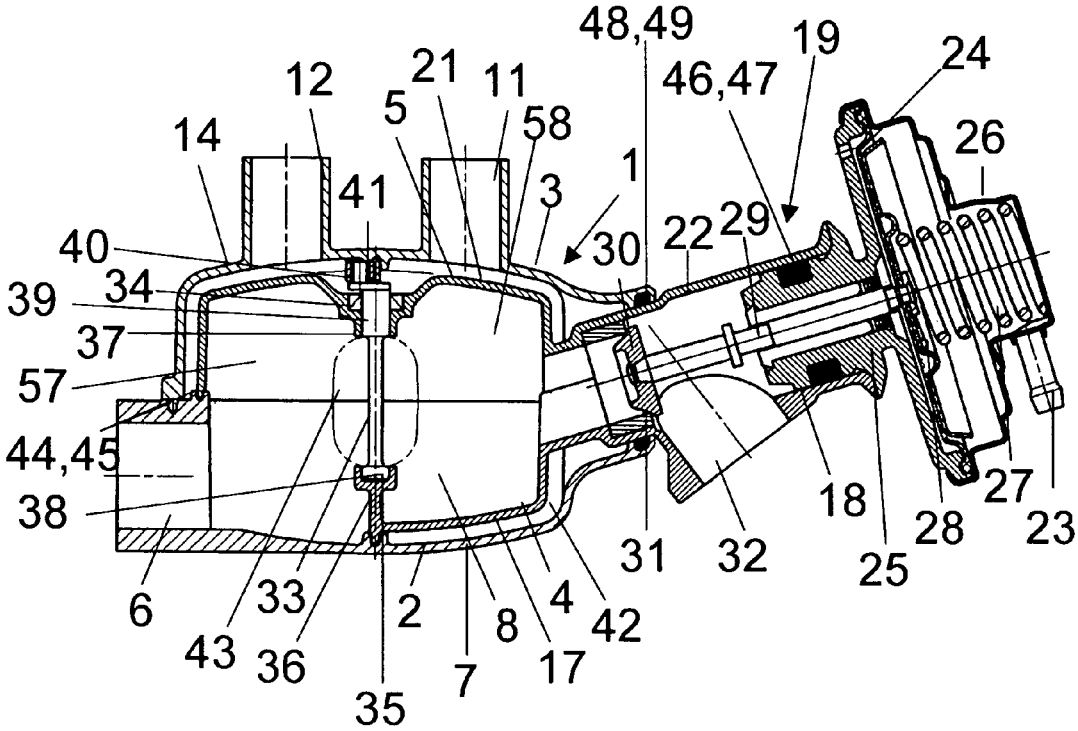
FIG. 1 shows in sectional view a front view of a first exhaust gas recirculation system according to the invention, whereby the sectional plane is arranged in the area of a bypass channel and the viewpoint is from a cooling device.

The construction of a first form of embodiment of an exhaust gas recirculation system according to the invention is for the most part clear from FIG. 1. It can be seen that a housing 1 is constructed from four housing shells 2, 3, 4, 5 that form or at least accept all functional parts.

Figure 3:
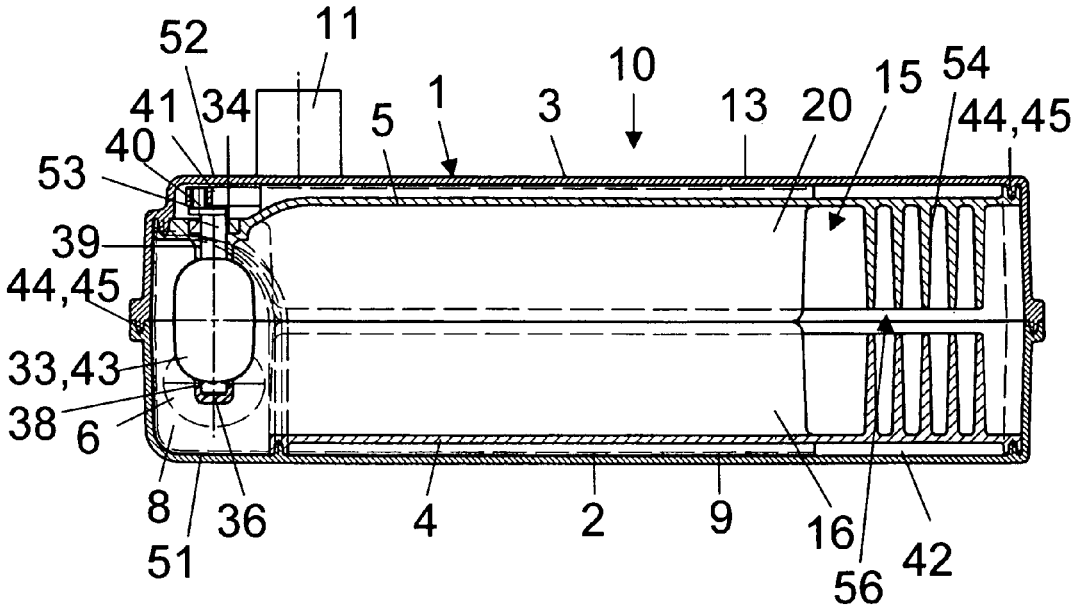
FIG. 3 shows in sectional view a side view of the exhaust gas recirculation system according to the invention from FIG. 2 whereby the viewpoint is towards the exhaust gas inlet and the sectional plane lies upstream of the bypass flap.
Figure 4:
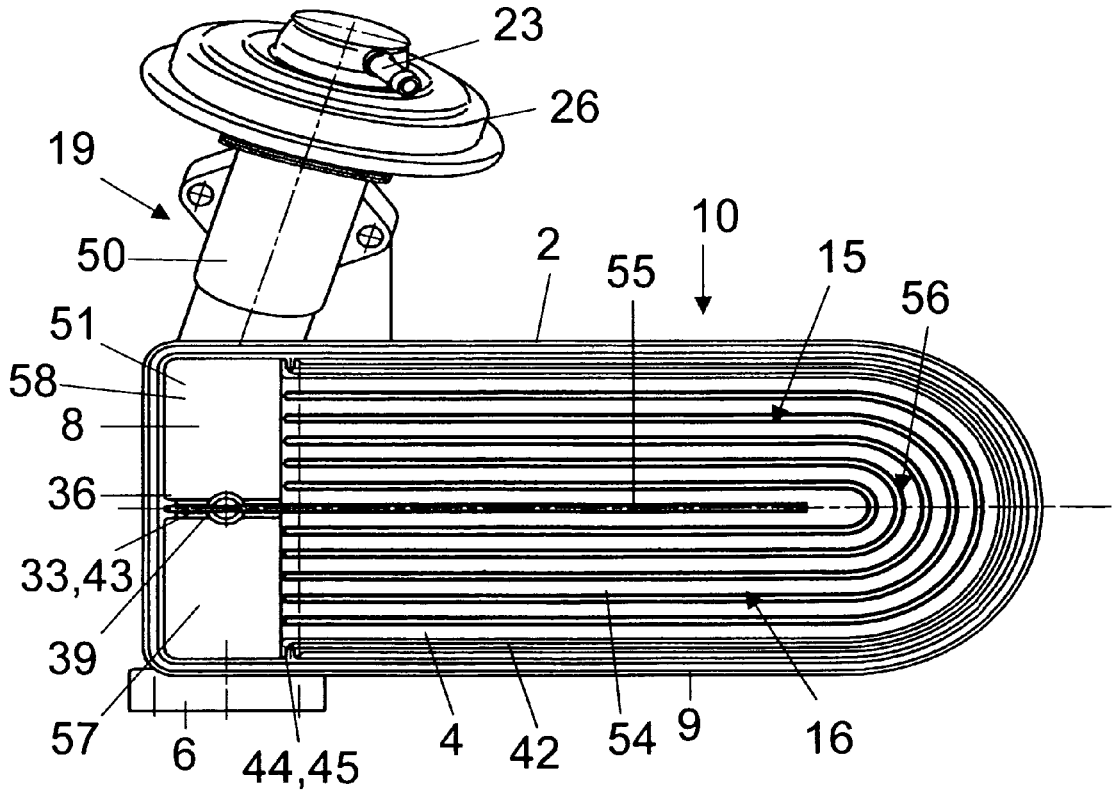
FIG. 4 shows a top view of the exhaust gas recirculation system according to the invention according to FIG. 1, whereby in the representation upper housing parts are removed in the area of the heat exchanger.
Figure 5:
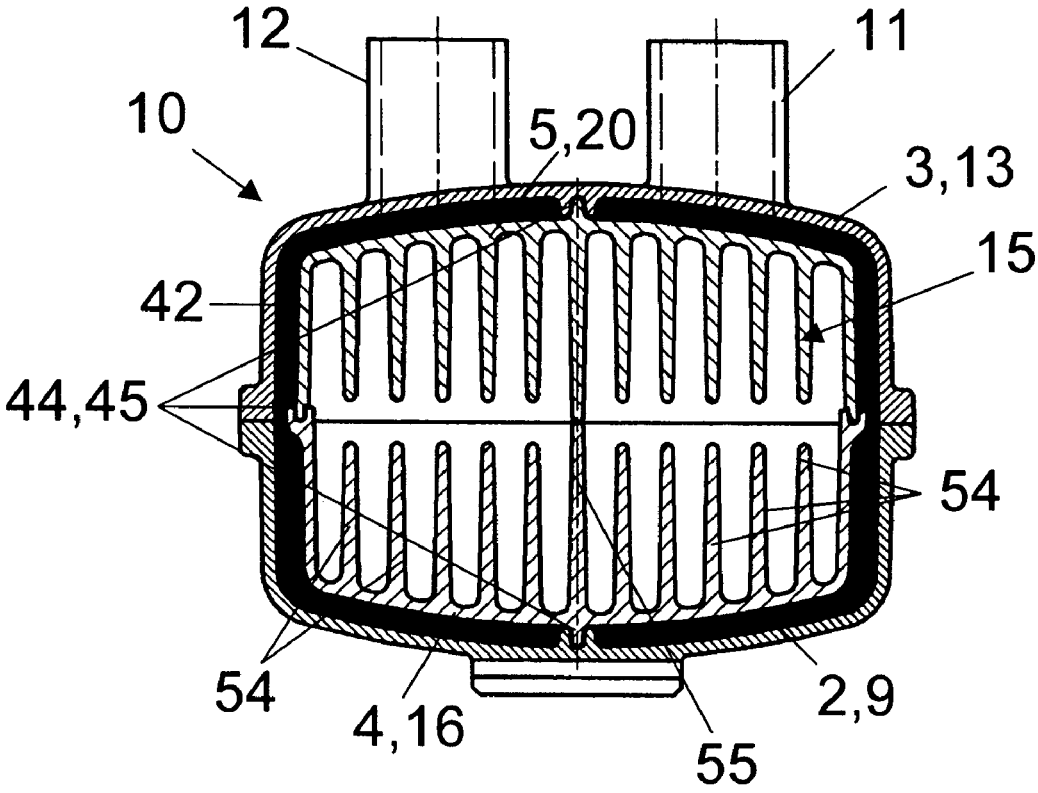
FIG. 5 in turn shows a front view of an exhaust gas recirculation system according to the invention in sectional view, whereby the sectional plane is arranged in the area of a cooling device.

In detail the first housing shell 2 forms an exhaust gas inlet 6 as well as a lower outer wall 7 of a bypass channel 8. Moreover, this housing shell 2 forms a lower part 9 of an exhaust gas cooling device 10 as can be seen in FIGS. 3–5. This outer-lying housing shell 2 is sealed to a great extent by a second housing shell 3 that has an inlet channel 11 and an outlet channel 12 for the coolant. In addition it forms an upper part 13 of the exhaust gas cooling device 10 as well as an upper outer wall 14 of the bypass channel 8. This housing shell 3 is mounted on the housing shell 2 via an adhesive connection with the interposition of the housing shells 4 and 5.

Thus the housing shells 4 and 5, which jointly form a heat exchanger unit 15, lie within these outer-lying housing shells 2, 3, as can be seen in particular in FIGS. 3 through 5. The lower inner housing shell 4 thereby forms a lower part 16 of the heat exchanger unit 15 as well as a lower inner wall 17 of the bypass channel 8 and forms in an extension of these surfaces a lower part 18 of a housing of an exhaust gas recirculation valve 19. The housing shell 5 in turn correspondingly forms an upper part 20 of the heat exchanger 15 as well as an upper inner wall 21 of the bypass channel 8 and an upper part 22 of the housing of the exhaust gas recirculation valve 19.

The lower part 18 and the upper part 22 accordingly in the present exemplary embodiment together form a receptacle for the exhaust gas recirculation valve 19, which is embodied as a connector valve. This connector valve 19 is a generic spring-loaded reed valve that is controlled via a vacuum line 23. To this end a reed 24 is clamped in a known manner between a connector housing part 25 and a cover 26 of the exhaust gas recirculation valve 19 and is tensioned in the closing direction via a coil spring 27, whereby the spring 27 is supported on its first side against the cover 26 and on the other side against a plate 28 arranged on the reed 24. The reed 24 or the plate 28 are connected to a valve rod 29 at whose end a valve closing element 30 is arranged that corresponds in a known manner with a valve seat 31 that is inserted into the housing lower part 18 or housing upper part 22 formed by the housing shells 4 and 5. By lifting the valve closing element 30 away from the valve seat 31, a fluid connection to an exhaust gas outlet 32 is produced that is also formed in the lower part 18 of the exhaust gas recirculation valve housing or in the housing shell 4.

In the bypass channel 8 a bypass flap 33 is arranged that is supported in an upper bearing position 34 formed in the housing shell 5 and in a lower bearing position 35 formed in the lower housing shell 4. In order to achieve a closing of the bypass channel 8 by the bypass flap 33, on the housing shells 4 and 5 a lower part 36 of an intermediate wall and an upper part 37 of the intermediate wall are embodied, whereby in the intermediate wall formed by the two halves 36, 37, an aperture governed by the bypass flap 33 is formed. Whereas the bypass flap 33 in the lower bearing position 35 is supported only via a crankshaft journal 38, the shaft 39 of the bypass flap 33 extends through the upper bearing position 34 and is connected there to a lever 40 that is in turn in interactive connection with a bi-metal spring 41. This bi-metal spring 41 forms a control element of the bypass flap 33 and is arranged in a coolant jacket 42 formed between the housing shell 3 and the housing shell 5, so that a switching of a bypass flap element 43 of the bypass flap 33 is dependent on the temperature of the coolant flow.

The housing shells 2, 3, 4, 5 are connected respectively via grooves 44 in which bars 45 of the respective other housing shell 2, 3, 4, 5 engage, whereby the permanent connection is achieved by adhering at these points. In order also to connect the housing shells 4, 5 in this manner, the adhesion point with the grooves 44 and the bars 45 should be displaced in the area of the coolant jacket 42. For this purpose an extension in the form of a flange can be embodied at the ends of the housing shells 4, 5 lying on top of one another, at whose ends pointing towards the heat exchanger unit 15 a groove is formed in both housing shells 4, 5 so that an air space is formed between the adhesion point, i.e. in the area of the groove 44 and the bar 45, which air space protects the adhesion point from too great a thermal load from the exhaust gas. This is not shown in the Figures.

Moreover it can be seen from FIG. 1 that on the connector valve 19 a seal 46 is arranged via which the housing 18, 22 against the connector housing part 25, in which the seal 46 is arranged in a groove 47, is sealed against the atmosphere. An additional sealing ring 48 is arranged in a groove 49 formed at the upper and the lower outer housing shell 2, 3 and ensures a sealing between the outer-lying housing shells 2, 3 and the lower part 18 or upper part 22 of the valve housing against the atmosphere. This area of the housing shells 2 and 3 is embodied so that it projects around the valve seat 31 of the exhaust gas recirculation valve 19, so that the latter is surrounded by coolant that flows between the housing parts 2, 4, or the housing parts 3, 5 and is part of the coolant jacket 42.

Figure 2:
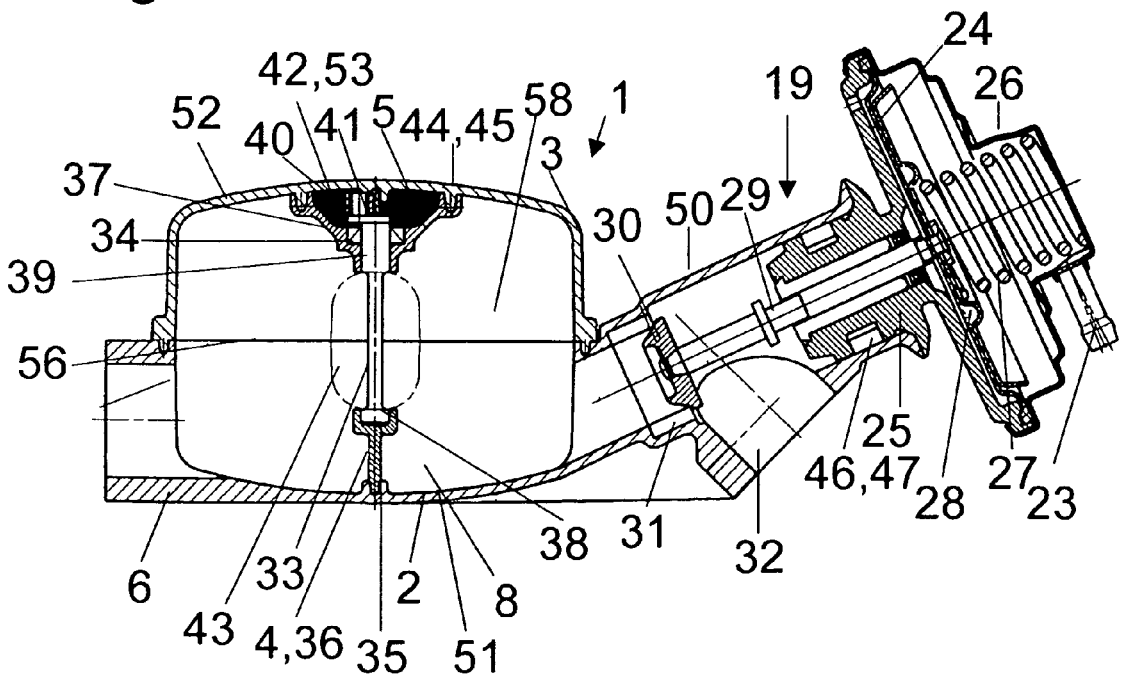
FIG. 2 shows a view according to FIG. 1 for an alternative exhaust gas recirculation system according to the invention.

The form of embodiment according to FIG. 2 differs from the form of embodiment according to FIG. 1 in that a housing 50 of the exhaust gas recirculation valve 19 is formed completely at the lower housing shell 2 and thus fulfils the function of the housing parts 18 and 22 of the first exemplary embodiment. Additionally the exhaust gas outlet 32 is also part of the housing shell 22. Moreover it can be seen that the bypass channel 8 is not surrounded by flowing coolant, but that its lower part 51 and its upper part 52 are formed directly by the housing shells 2, 3. In order for coolant nonetheless to flow round the bi-metal spring 41, the upper housing shell 5 is embodied so that it forms an additional chamber 53 that is arranged in the area above the bypass flap 33 and is connected to the coolant jacket 42 lying behind it. The coolant jacket 42 is thereby conducted from the side of the heat exchanger 15 to immediately at the housing 50 of the exhaust gas recirculation valve 19, as can be seen in FIG. 3, whereby the housing 50, since it is in direct contact with the coolant, ensures a good heat transfer in the area of the valve seat 31 so that the latter is cooled by the coolant. The other parts having the same function compared with the embodiment according to FIG. 1 are labeled in FIG. 2 with the same reference numbers.

In FIG. 3 through 5, further views of the forms of embodiment according to the invention of the exhaust gas recirculation system and in particular of the heat exchanger unit 15 are shown. Thus it is clear that the coolant jacket 42 is embodied between the outer housing shells 2 and 3 and the inner housing shells 4 and 5. Moreover the arrangement of the bypass flap 33 can be seen. Apart from the outer wall of the coolant jacket 42, the heat exchanger unit 15 is formed by the housing shells 4, 5, on which ribs 54 are embodied for an improved heat transfer, which ribs in the assembled state of the housing shells 4 and 5 point towards one another. The ribs 55 arranged respectively centrally in the cross-section feature a length such that they meet in the middle, which ensures that when the bypass flap is closed, the exhaust gas flow must flow through the entire heat exchanger unit 15 and is only deflected by 180° in the rear area 56 of the heat exchanger unit 15 in order thus to reach the exhaust gas outlet. So that the coolant flow must also flow via this path in the coolant jacket 42 either co-current or countercurrent, grooves 44, in which bars 45 of the housing shells 4, 5 engage, are in turn embodied centrally in the housing shells 2, 3 in cross-section, i.e. in extension of the ribs 55. So that the coolant flow can travel from the coolant inlet 11 to the coolant outlet 12, it must thus flow via the rear area 56 of the heat exchanger unit 15, where the vertical separating wall formed by the bars 44 and grooves 45 is no longer embodied. This coolant path, but also the path of the exhaust gas flow, is evident particularly from FIG. 4, whereby it is seen that the ribs 55 standing on one another are accordingly not embodied in the rear area 56 and the ribs 54 are embodied with a deflection of 180°.

The functioning of this exhaust gas recirculation system according to the invention is described below. When the exhaust gas recirculation valve 19 is opened, thus when the valve element 30 is lifted away from the valve seat 31, an exhaust gas flow flows into the exhaust gas inlet and into a first chamber 57, which in the exemplary embodiment according to FIG. 1 is limited by the housing shells 2 or 4 and 5 or according to FIG. 2 by the housing shells 2 and 3. When the combustion engine is cold and thus the coolant in the coolant jacket 42 is cold, the bi-metal spring 41 arranged in the coolant jacket 42 effects an opening of the bypass flap element 43, so that the exhaust gas can flow uncooled into a second chamber 58 behind the bypass flap 33, which in the first exemplary embodiment is formed by the housing shells 4 and 5 and in the second exemplary embodiment by the housing shells 2 and 3. From here the exhaust gas flows past the valve seat 31 or the valve closing element 30 into the housing 18, 22 or 50 of the exhaust gas recirculation valve 19, which is formed either by housing shells 4 and 5 or by the housing shell 2. From here the exhaust gas flow in turn reaches the exhaust gas outlet 32, from where it again flows to the induction pipe of the combustion engine.

By introducing this hot exhaust gas into the induction pipe, the engine is quickly heated up, so that likewise the coolant of the combustion engine heated more rapidly flows into the coolant jacket 42. When a switching temperature of the coolant and thus of the bi-metal spring 41 is achieved, the bypass flap 33 is activated and the aperture between the chambers 57 and 58 is closed, so that exhaust gas can no longer flow through the bypass channel 8. Instead, the exhaust gas then flows through between the ribs 54 of the heat exchanger unit 15 and is deflected by 180° in the rear area 56, so that the exhaust gas flow reaches the second chamber 58 cooled, from where the exhaust gas can in turn be conducted to the induction pipe via the exhaust gas recirculation valve 19. The exhaust gas is cooled thereby via a heat transfer between the flowing exhaust gas and the ribs 54 of the heat exchanger unit 15, which are cooled by the coolant flowing in the surrounding coolant jacket 42. The coolant jacket 42 is thereby connected in a known manner as a rule to the coolant circulation of the combustion engine via the coolant inlet 11 and the coolant outlet 12.

Thus an exhaust gas recirculation system is created that features a low construction space requirement and is coordinated optimally as a complete unit. Such a unit leads to a reduction in weight and cost compared with known embodiments, not least because all the housing shells can be produced in a simple die-casting method. Moreover a very good efficiency of the cooling device is achieved and an additional cooling of the valve seat is ensured.

It should be clear that modifications of the exhaust gas recirculation system according to the invention are possible. While the present invention has been described with reference to certain preferred embodiments, one of ordinary skill in the art will recognize that additions, deletions, substitutions, modifications and improvements can be made while remaining within the spirit and scope of the present invention as defined by the appended claims.

For example the arrangement of the coolant inlets or outlets or the arrangement of the exhaust gas inlets or outlets can be selected differently. For example it is thus also conceivable to arrange the exhaust gas recirculation valve in the area of the exhaust gas inlet. The bearing or receptacle of the flaps or the type of activation of the exhaust gas recirculation valve or of the bypass flap can be implemented in a different manner by electromagnetic or electromotive means, without leaving the scope of the main claim. Likewise those skilled in the art will understand that the exemplary embodiments are only favorable divisions and shapes, so that if necessary the housing shells 2, 3, 4, 5 can be divided in a different manner.

What is claimed is:

1. An exhaust gas recirculation system for a combustion engine comprising:

(a) an exhaust gas inlet;

(b) an exhaust gas outlet;

(c) an exhaust gas recirculation valve;

(d) an exhaust gas recirculation valve housing;

(e) an exhaust gas cooling device including i. a heat exchanger unit constructed to allow flow of coolant therein, ii. a bypass channel connected to bypass the heat exchanger unit, and iii. a bypass flap disposed in the bypass channel; and (f) a housing containing the heat exchanger unit, the bypass flap, and at least a portion of the housing the exhaust gas recirculation valve, wherein at least one valve seat is disposed in the portion of the exhaust gas recirculation valve housing;

whereby the valve seat is coolable by the coolant; and wherein the exhaust gas recirculation valve, the exhaust gas cooling device, the heat exchanger unit, and the bypass channel form a unit.

2. An exhaust gas recirculation system for a combustion engine according to claim 1, wherein said valve seat of said exhaust gas recirculation valve is disposed between said bypass channel or said heat exchanger unit and said exhaust gas outlet.

3. An exhaust gas recirculation system for a combustion engine according to claim 1, wherein said housing of said exhaust gas recirculation system and said heat exchanger unit is constructed from a total of four housing shells.

4. An exhaust gas recirculation system for a combustion engine according to claim 3, wherein said shells are die-cast shells.

5. An exhaust gas recirculation system for a combustion engine according to claim 1, wherein a first housing shell forms said exhaust gas inlet, a lower part of said exhaust gas cooling device, and a lower outer wall of said bypass channel, a second housing shell forms an upper part of said exhaust gas cooling device including a coolant inlet and a coolant outlet, and an upper outer wall of said bypass channel, a third housing shell forms a lower part of said heat exchanger unit, a lower part of said housing of said exhaust gas recirculation valve, said exhaust gas outlet, a lower inner wall of said bypass channel, and a lower part of an intermediate wall in which said bypass flap is disposed including a lower bearing position of said bypass flap, and a fourth housing shell forms an upper part of said heat exchanger unit, an upper part of said housing of said exhaust gas recirculation valve, an upper inner wall of said bypass channel, and an upper part of the intermediate wall in which said bypass flap is disposed including an upper bearing position of said bypass flap.

6. An exhaust gas recirculation system for a combustion engine according to claim 5, wherein said exhaust gas recirculation valve comprises a connector valve inside said exhaust gas recirculation valve housing and said valve seat is disposed to be coolable by coolant flowing around it.

7. An exhaust gas recirculation system for a combustion engine according to claim 1, wherein:

a first housing shell forms said exhaust gas inlet, said exhaust gas outlet, a lower part of said exhaust gas cooling device, a lower part of said bypass channel, and said housing of said exhaust gas recirculation valve, the second housing shell forms an upper part of said exhaust gas cooling device, said coolant inlet, said coolant outlet, and an upper part of said bypass channel, the third housing shell forms a lower part of said heat exchanger unit, a lower part of an intermediate wall in which the bypass flap is disposed including a lower bearing position of said bypass flap, and the fourth housing shell forms an upper part of the heat exchanger unit and an upper part of the intermediate wall in which the bypass flap is disposed including an upper bearing position of said bypass flap.

8. An exhaust gas recirculation system for a combustion engine according to claim 7, wherein said exhaust gas recirculation valve comprises a connector valve inside said housing of said exhaust gas recirculation valve and said valve seat is disposed for cooling immediately adjacent to a coolant jacket embodied between said first and third housing shells as well as between said second and fourth housing shells.

9. An exhaust gas recirculation system for a combustion engine according to claim 1, wherein said bypass flap is controlled at least indirectly via a temperature-sensitive bi-metal spring.

10. An exhaust gas recirculation system for a combustion engine according to claim 9, wherein said coolant flows around said bi-metal spring.

11. An exhaust gas recirculation system for a combustion engine according to claim 1, wherein said housing comprises a plurality of housing shells connected via one or more adhesive connections between one or more grooves in a housing shell and one or more bars in another housing shell.

12. An exhaust gas recirculation system for a combustion engine according to claim 1, further comprising a coolant jacket in the area of said cooling device, wherein the coolant jacket surrounds the entire circumference of said heat exchanger unit in cross-section.

13. An exhaust gas recirculation system for a combustion engine according to claim 11, further comprising a cooling jacket and one or more further grooves disposed so as to form an air space, wherein said connection between said bars and grooves is disposed in the area of the coolant jacket and the one or more further grooves are disposed between an area of said heat exchanger unit through which the exhaust gas flows and said bars and grooves on both housing shells.

14. An exhaust gas recirculation system for a combustion engine comprising:

(a) an exhaust gas inlet;

(b) an exhaust gas outlet;

(c) an exhaust gas recirculation valve;

(d) an exhaust gas recirculation valve housing;

(e) an exhaust gas cooling device including i. a heat exchanger unit constructed to allow flow of coolant therein, ii. a bypass channel connected to bypass the heat exchanger unit, and iii. a bypass flap disposed in the bypass channel; and (f) a housing containing the heat exchanger unit, the bypass flap, and at least a portion of the housing the exhaust gas recirculation valve, wherein at least one valve seat is disposed in the portion of the exhaust gas recirculation valve housing;

whereby the valve seat is coolable by the coolant sufficiently to largely prevent carbonization and sticking of a valve member on the valve seat; and wherein the exhaust gas recirculation valve, the exhaust gas cooling device, the heat exchanger unit, and the bypass channel form a unit.

* * * * *